US008282201B2

(12) United States Patent
Kessler

(10) Patent No.: US 8,282,201 B2
(45) Date of Patent: Oct. 9, 2012

(54) LOW FORCE DRUM MAINTENANCE FILTER

(75) Inventor: Kelly Anne Kessler, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 248 days.

(21) Appl. No.: 12/643,246

(22) Filed: Dec. 21, 2009

(65) Prior Publication Data

US 2011/0149002 A1 Jun. 23, 2011

(51) Int. Cl.
*B41J 2/17* (2006.01)
*B41J 2/175* (2006.01)

(52) U.S. Cl. ..... 347/93; 347/84

(58) Field of Classification Search ..... None
See application file for complete search history.

(56) References Cited

U.S. PATENT DOCUMENTS 5,389,958 A * 2/1995 Bui et al. ..... 347/103
7,036,920 B2 5/2006 Rousseau et al.
7,048,369 B2 5/2006 Rousseau et al.
7,537,333 B2 5/2009 Kessler et al.
2005/0134630 A1* 6/2005 Rousseau et al. ..... 347/28
2005/0134658 A1* 6/2005 Rousseau et al. ..... 347/85
2005/0151808 A1* 7/2005 Andersen et al. ..... 347/86

* cited by examiner

*Primary Examiner* — Matthew Luu
*Assistant Examiner* — Kendrick Liu
(74) *Attorney, Agent, or Firm* — Maginot, Moore & Beck, LLP

(57) ABSTRACT

A drum maintenance system for use in an imaging device includes a sump having a bottom surface and a plurality of sidewalls which are arranged to accommodate a volume of release agent. A roller applicator is rotatably supported a first distance above the sump and partially submerged in the release agent in the sump. A foam layer is positioned on the bottom surface of the sump beneath the roller applicator that has a first thickness that is greater than the first distance such that the foam layer is compressed between the roller applicator and the bottom surface of the sump. A filter is sandwiched between the foam layer and the roller applicator. The compressed foam layer provides a compliance force that presses the filter against the roller applicator. The filter is configured to permit rotation of the roller applicator positioned on top of the foam layer while being pressed against the roller applicator by the foam layer.

15 Claims, 5 Drawing Sheets

LOW FORCE DRUM MAINTENANCE FILTER

TECHNICAL FIELD

This disclosure relates generally to printers having a rotatable drum and, more particularly, to the components and methods for metering release agent on a rotatable drum in a printer.

BACKGROUND

Phase change ink printers conventionally receive marking material in a form known as an ink stick. The ink stick is a solid or semi-solid structure that may have any convenient shape (e.g., a pellet, block, brick, cube, or any other structure) for handling and loading into the printer. During use, ink sticks are inserted through an insertion opening of an ink loader for the printer and pushed or slid along a feed channel by a feed mechanism and/or gravity toward an ink melting assembly in the printer. The ink melting assembly melts the solid ink stick into a liquid that is delivered to one or more printheads for jetting onto an ink receiving surface.

Phase change ink imaging devices may be direct printing devices or indirect printing devices (also referred to as offset printers). In a direct printing device, the melted phase change ink may be emitted by the printhead(s) directly onto the surface of a recording medium. In offset printers, the melted phase change ink is emitted onto an imaging member that may be in the form of a rotating drum or a supported endless belt or band. A transfix roller is leveraged against the imaging member to form a transfer nip through which recording media are fed in timed registration with position of the ink on the imaging member. The pressure in the transfer nip causes the jetted phase change ink to transfer from the imaging member to the recording sheet.

In printers with an imaging member in the form of a rotatable drum, a release agent is often applied to the imaging member to form an intermediate transfer surface on the surface of the drum onto which the melted phase change ink is deposited by the printheads. The release agent is typically an oil or similar fluid material such as a silicone fluid that facilitates release of the melted phase change ink from the surface of the drum to the recording media in the transfer nip. Examples of systems or processes that utilize intermediate imaging members with release agents are shown in U.S. Pat. Nos. 5,372,852, 5,389,958, and 7,128,412.

To enable the use of release agent, phase change ink printers have been provided with release agent application systems. An example of a previously known release agent application system for a phase change ink printer is shown in FIG. 5. As depicted, the release agent application system includes a release agent applicator, in the example it is in the form of a roller, and a reservoir, such as a tub or trough, which holds a supply of release agent for the roller. The roller is formed of an absorbent material, such as extruded polyurethane foam, and is positioned with respect to the reservoir so as to be partially exposed to reclaimed release agent therein. Capillary forces cause the foam roller to absorb reclaimed release agent from the reservoir. The applicator contacts the surface of the imaging drum and applies release agent to the drum surface as the drum rotates. Once the release agent is deposited onto the imaging drum, the thickness of the release agent on the imaging drum is controlled by a metering blade so the amount of oil on the imaging member does not degrade the media sheet in the nip, the image being produced or interfere with ink transfer to the media. The metering blade is positioned to divert the excess oil away from the imaging drum and back into the release agent reservoir where it is reclaimed for reuse.

The reservoir is provided with a filter for removing debris, such as paper dust, dried ink, and the like, from the release agent prior to being reused by the applicator. The filter is positioned between the applicator and the release agent in the lower portion of the reservoir. A ground shield in the form of an L-shaped piece of metal is provided in the reservoir to position the filter and to act as a barrier for the excess release agent and contaminants it carries as it flows in a return path when diverted from the drum surface by the metering blade. In particular, the horizontal portion of the L-shape is positioned beneath the applicator and provides a spring like compliance force that presses the filter upward against the applicator surface and at the vertical portion of the L-shape applies a lateral grounding contact force against the applicator surface. The vertical portion of the support is positioned between the applicator and wall of the reservoir. The L-shaped support is spaced from the wall and bottom portion of the reservoir to shield the applicator from the reclaimed release agent and at the same time provide a flow path for the reclaimed release agent. The flow path directs the reclaimed release agent to the bottom portion of the reservoir where it is absorbed through the filter before reaching the applicator.

The compliance force applied by the L-shaped support varies based on bend angle tolerances, misalignment of the L-shaped support and roller with respect to each other as well as roller diameter variations as occurs in the normal manufacturing process. These system tolerance variations in turn cause variations in the force applied to the filter and roller such that the force may be increased to a degree that prevents the roller from rotating. At the opposite extreme of tolerance variation, a gap between the roller and filter or reduced area of contact may impede reclaim oil absorption into the roller.

SUMMARY

To address the difficulties associated with using a rigid bracket or support device for pressing the filter against the foam roller of a drum maintenance unit, a drum maintenance system has been developed that provides the compliant force between the filter and roller while allowing for variation in the roller diameter and other system tolerances without the force between the roller and filter being sensitive to that variation. In particular, in one embodiment, such a drum maintenance system includes a sump having a bottom surface and a plurality of sidewalls which are arranged to accommodate a volume of release agent. A roller applicator is rotatably supported a first distance above the sump and partially submerged in the release agent in the sump. A compressible porous layer is positioned on the bottom surface of the sump beneath the roller and is compressed between the roller applicator and the bottom surface of the sump. A filter specific material is sandwiched between the porous layer and the roller applicator. The porous material may provide an additional filtering function. The compressed foam layer provides a low force compliance that presses filter material against the roller applicator. The filter is configured to permit rotation of the roller applicator positioned on top of the foam layer while being pressed against the roller applicator by the porous layer.

In another embodiment, a method of operating an imaging device is provided. The method includes applying release agent to an imaging member of an imaging device using a roller of a drum maintenance unit. At least a portion of the applied release agent is diverted into to a cavity of the drum maintenance unit with a metering blade. The release agent is then directed from the cavity to a sump underneath the roller. A compressible porous layer is positioned in the sump to absorb the diverted release agent. A filter is sandwiched between the roller and the compressible layer so that the absorbed release agent is transferred to the roller through the filter.

BRIEF DESCRIPTION OF THE DRAWINGS

The foregoing aspects and other features of a method and apparatus for applying a release agent to an imaging member are explained in the following description, taken in connection with the accompanying drawings, wherein.

DETAILED DESCRIPTION

Figure 1:
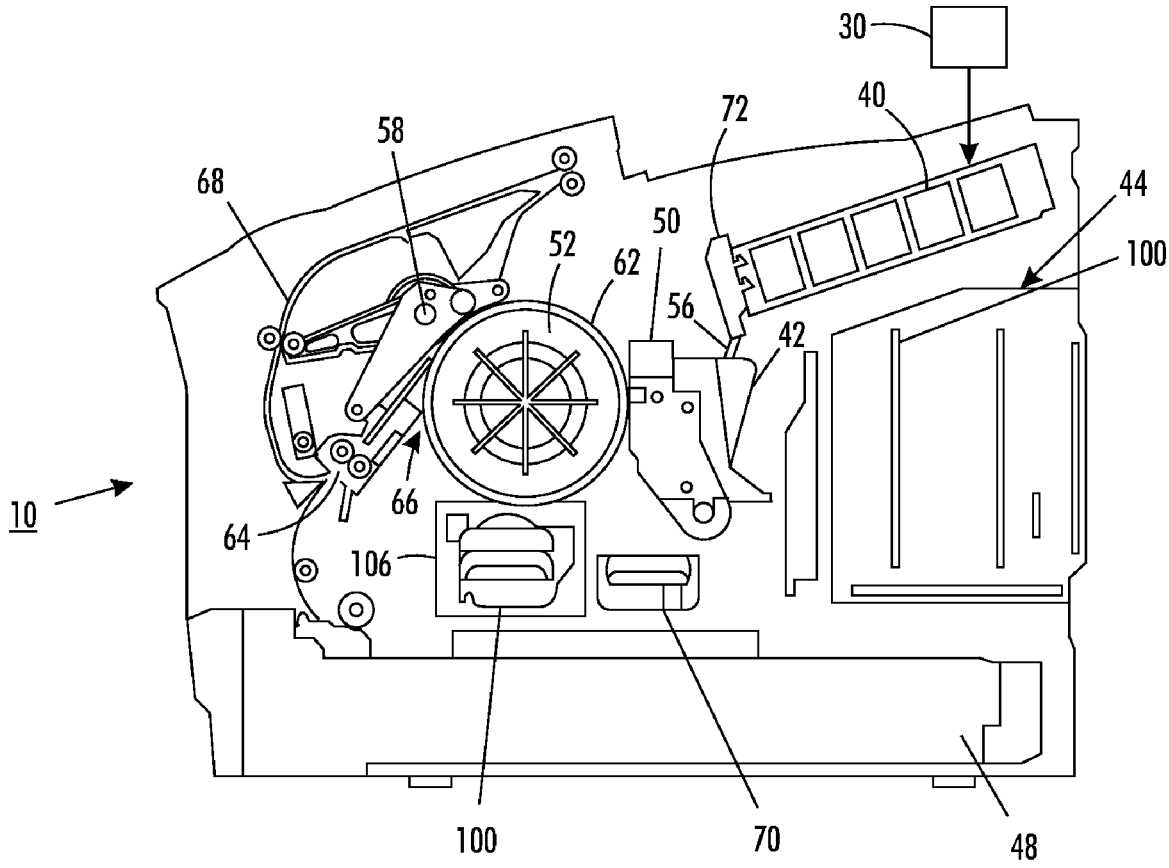
FIG. 1 is a side schematic view of an exemplary phase change ink printer that includes a drum maintenance unit.

For a general understanding of the present embodiments, reference is made to the drawings. In the drawings, like reference numerals have been used throughout to designate like elements. As used herein, the term "imaging device" generally refers to a device for applying an image to print media. "Print media" may be a physical sheet of paper, plastic, or other suitable physical print media substrate for images, whether precut or web fed. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which an image receiving surface, e.g., media sheet or web, or intermediate transfer drum or belt, onto which the image is transferred, moves through the imaging device. The cross-process direction, along the same plane as the image receiving surface, is substantially perpendicular to the process direction.

FIG. 1 is a side schematic view of an embodiment of a phase change ink imaging device configured for indirect or offset printing. As depicted in FIG. 1, the device 10 includes an intermediate imaging member 52 that is shown in the form of a drum, but may also be in the form of an endless belt. Hereafter the term drum refers generally to the image receiving surface or support surface of the intermediate transfer film and so includes any form of roller, belt or band. The imaging drum 52 has an image receiving surface 62 that is movable in at least direction 16, and on which phase change ink images are formed. A transfix roller 19 rotatable in the direction 17 is loaded against the surface 62 of drum 52 to form a transfix nip 66, within which ink images formed on the surface 62 are transfixed onto a recording media, such as a cut media sheet or a continuous web of media.

In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. The imaging device 10 includes an ink loader configured to receive phase change ink in solid or substantially solid form, also referred to as solid ink sticks or blocks 30, and delivers the ink sticks 30 to an ink melting assembly 72 that melts the ink to a liquid form for jetting by the print head 50. In one embodiment, the melted phase change ink is directed to a reservoir 42 of the printhead that holds the melted ink and delivers it to ink jets (not shown) incorporated into the print head 50. The melted ink may be directed by a suitable conduit or tube 56 which may be heated to maintain the ink in liquid or molten form. Alternatively, the melt assembly 72 and the reservoir 42 may be positioned with respect to each other so that the ink drips or falls into the reservoir from the melt assembly. The imaging device may be configured to use a single color or multiple colors of ink and therefore may include a separate delivery channel or system and melt assembly (not shown) for each color of ink utilized in the device.

As further shown, the imaging device 10 includes a media supply and handling system that is configured to transport recording media through the transfix nip 66. The media supply and handling system may include at least one media source, such as supply tray 48 for storing and supplying image receiving media in the form of cut sheets, for example. Alternatively, the source of media may comprise a spool or other similar device that provides a substantially continuous web of media. The substrate supply and handling system includes suitable mechanisms such as rollers, baffles, and the like for guiding media from the tray and through the transfix nip. A media heater, i.e., pre-heater assembly 64, may be positioned along the path for preheating the media prior to reaching the transfix nip 66.

In operation, solid ink sticks 30 are loaded into ink loader 40 through which they travel to the melting assembly 72. At the melting assembly 72, the ink stick 30 is melted and the liquid ink is directed to the reservoir 42 in the print head 50. The ink is ejected by ink jets in the printhead to form an image on the surface 62 of imaging drum 52 as the drum rotates. A recording media is directed into the pre-heater 64 so the recording media is heated to a more optimal temperature for receiving the ink image and then directed into the transfix nip 66 in timed registration with the ink deposited on the drum 52 by the printhead 50.

The operations of the printer 10 are controlled by a controller 100 implemented in the electronics module 44. The electronics module 44, for example, is a self-contained, dedicated mini-computer having suitable components and systems, such as a central processor unit (CPU), memory, a display, and user interface (UI), that enable the controller to monitor and control the operations of the device 10. The controller 100 receives signals from the various components and subsystems of the device 10 and generates control signals that are delivered to the components and subsystems. These control signals, for example, include drive signals for the ink jets that cause the jets to expel ink to form the image on the imaging drum 52 as the drum rotates past the print head.

Figure 2:
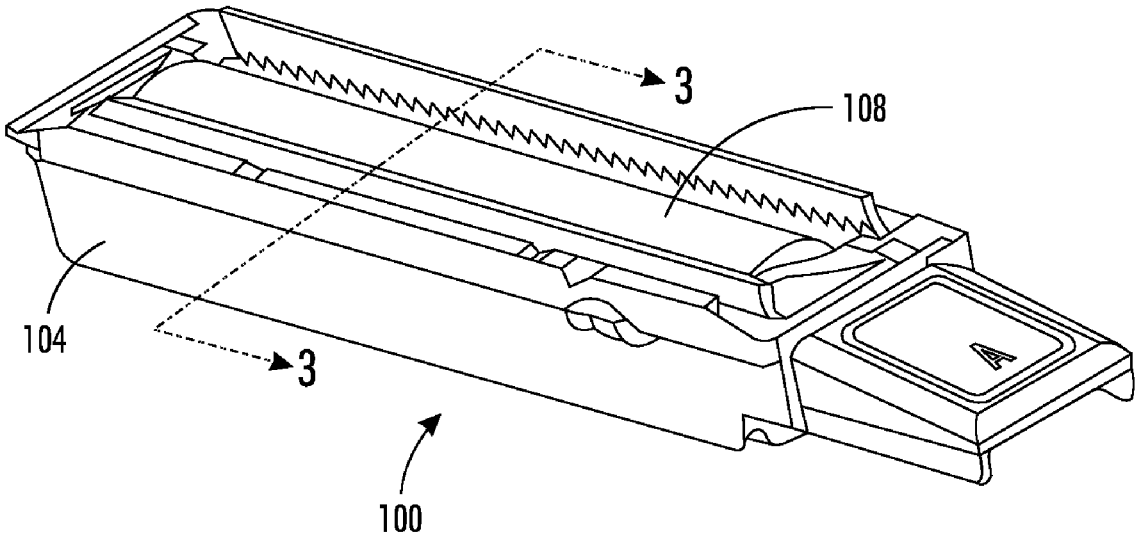
FIG. 2 is perspective view of an embodiment of the drum maintenance unit of the imaging device of FIG. 1.

To facilitate transfer of an ink image from the drum to a recording medium, the imaging device is provided with a release agent application system 100, also referred to as a drum maintenance unit (DMU), that applies a layer of release agent to the surface 62 of the drum 52 upon which the ink is deposited by the print head 50. As depicted in FIG. 2, the DMU 100 may comprise a customer replaceable unit (CRU). As used herein, a CRU is a self-contained, modular unit which includes all or most of the components necessary to perform a specific task within the imaging device enclosed in a housing or frame that enables the CRU to be inserted and removed from the imaging device as a functional self-contained unit. The DMU 100 includes a housing 104 in which the components of the DMU 100, such as the applicator 108, are enclosed. The DMU typically does not contact the drum other than during a cleaning and/or fluid release layer application. It is common for the DMU to be cycled through a motion range into and clear of the drum by means of mechanisms outboard of the DMU module, such as by pivoting with a cam and drive system.

As depicted in FIG. 1, the imaging device 10 in which the DMU 100 is used includes a DMU insertion opening, or docking slot, 106 that enables the insertion and removal of the DMU 100 from the imaging device 10. The imaging device 10 and/or the DMU housing 104 may be provided with suitable attachment features (not shown), such as fastening mechanisms, latches, positioning guide features, and the like, to position the DMU 100 in the correct position with respect to the imaging drum 52. The exact method of releasably securing the DMU 100 in its inserted or docked position is not critical and any suitable method may be used.

Figure 3:
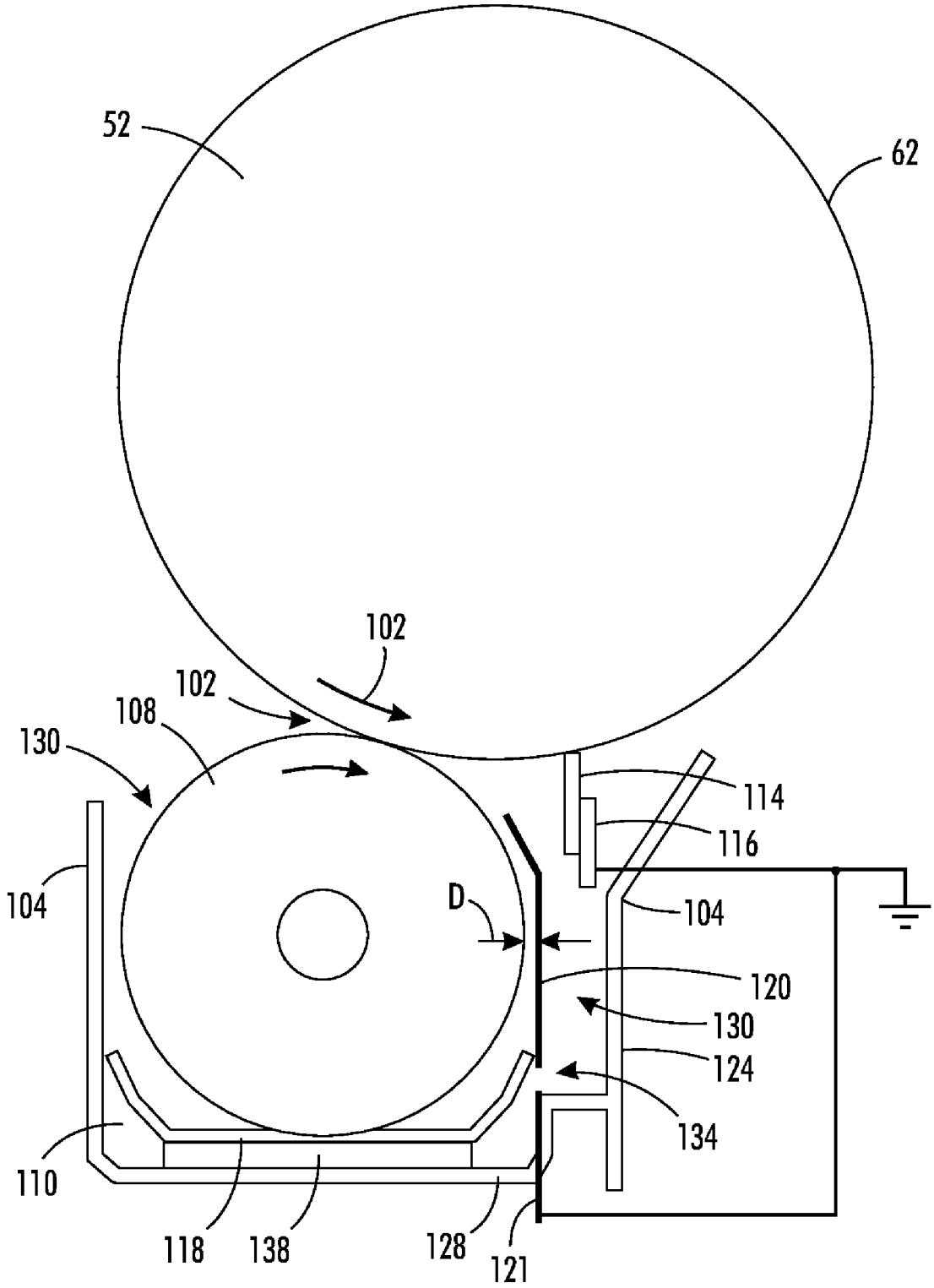
FIG. 3 is a side cross-sectional view of the drum maintenance unit of FIG. 2.

FIG. 3 shows a side cross-sectional view of an embodiment of a DMU 100 for use with indirect phase change ink imaging devices such as the device 10 of FIG. 1. As depicted, the DMU 100 includes an applicator 108 in the form of a roller. In embodiments, the roller 108 is formed from an absorbent material, such as extruded polyurethane foam. The polyurethane foam has an oil retention capacity and a capillary height that enables the roller to retain fluid even when fully saturated with release agent fluid. For example, the polyurethane foam may have an oil retention capacity (volume of oil/volume of foam) of at least 60 percent, and most preferably 70 percent, and a capillary height of at least nine inches. The roller 20 may have an outer diameter of 1.75 inches (44.45 mm), a length of 8.24 inches (209.3 mm) and is mounted on a shaft 30 having a diameter of 0.375 inches (9.53 mm). Advantageously, by forming the roller 20 from a material having a capillary height that is greater than the length of the roller, it is assured that a fully saturated roller will not leak or drip, regardless of orientation. The roller 108 is rotatably supported in the housing 104, also referred to as a drawer or tray. The DMU housing may be formed of any suitable type of material, such as molded plastic.

The housing defines a reservoir, or sump, 110 in which a volume of release agent may be held. The release agent may be a silicone oil although any suitable release agent may be used. The roller 108 is mounted in the housing 104 so that a portion of the roller 108 is submerged when a volume of release agent is present in the sump 110. The housing 104 in turn is positioned within the imaging device 10 so that another portion of the roller 108 contacts the surface 62 of the imaging drum 52. In one embodiment, the DMU 100 is coupled to a positioning mechanism (not shown) that is configured to selectively move the DMU 100, or at least the applicator and blade of the DMU, into and out of contact with the imaging drum. In alternative embodiments, the applicator may be positioned so that it remains in contact with the imaging drum throughout its operational life.

In operation, as the imaging drum rotates in direction 16, the roller 108 is driven to rotate in the direction of arrow 17 by frictional contact with the imaging drum surface 62 while applying release agent thereto. As the roller 108 rotates, the point of contact between the roller 108 and the drum surface 62 continuously moves so that a fresh portion of the roller 108 is continuously contacting the drum surface 62 to apply the release agent thereto. A metering blade 114 is positioned to meter the release agent applied to the surface 62 of the drum by the applicator to a desired thickness. In embodiments, the blade 114 is comprised of an elastomeric material and may be incorporated into the DMU 100 or provided as a separate unit from the DMU 100. In the embodiment of FIG. 2, the metering blade is attached to the housing 104 by a mounting bracket 116. The described continuous rotation of the roller may be at a somewhat constant speed complementary to the drum rotation surface speed or at a reduced relative surface velocity or, less desirably, it may be a series of intermittent motions, as example, a stick-slip motion. The application roller is not intended to remain stationary during the drum maintenance operation due chiefly to considerations for wear and oil transfer efficiency.

The oil impregnated roller 108 applies enough oil to the drum surface 62 to maintain a constant puddle or "oil bar" (not shown) in front of the blade 116 to insure that there is always a sufficient amount of oil available to spread over the area just ahead of blade contact and to be metered such that a fairly precise film covers the functional imaging area of the drum or image receiving surface. In addition to metering the release agent onto the surface 62 of the drum 52, the metering blade is configured to divert excess release agent from the drum surface toward the sump 110.

To prevent the diverted release agent from contaminating the roller 108, a shield structure 120, which may also be referred to as a wall, rail, or strip, is positioned in the DMU housing 104 between the roller 108 and a side wall 124 of the DMU housing 104. In one embodiment, the shield 120 comprises a substantially planar member formed of a suitable rigid material that extends substantially vertically from a lower portion of the sump 110 toward the open top 130 of the sump 110. The planar body of the shield may include various bends, angled surfaces, curved portions, and the like to optimize the ability of the shield to prevent reclaimed ink and debris from contaminating the roller for a given roller and sump geometry as well as to facilitate integration and mounting of the shield at an appropriate location within the sump.

The shield may comprise a single component or be made up of multiple assembled components. Any suitable material or combination of materials may be used for the shield. As explained below, at least a portion or at least one component of the shield is formed of a sufficiently electrically conductive material, such as stainless steel, to function as a static grounding element for the shield. For example, in embodiments in which the shield comprises a single component, substantially the entire shield may be configured to serve as the grounding element. Alternatively, the grounding element may comprise a strip or rail of conductive material affixed to the shield. In either case, the grounding portion or element of the shield may include suitable tabs, terminals, or similar features (such as tab 121 of FIG. 3) that enable the conductive shield or portion of the shield to be operably connected to ground potential.

Figure 5:
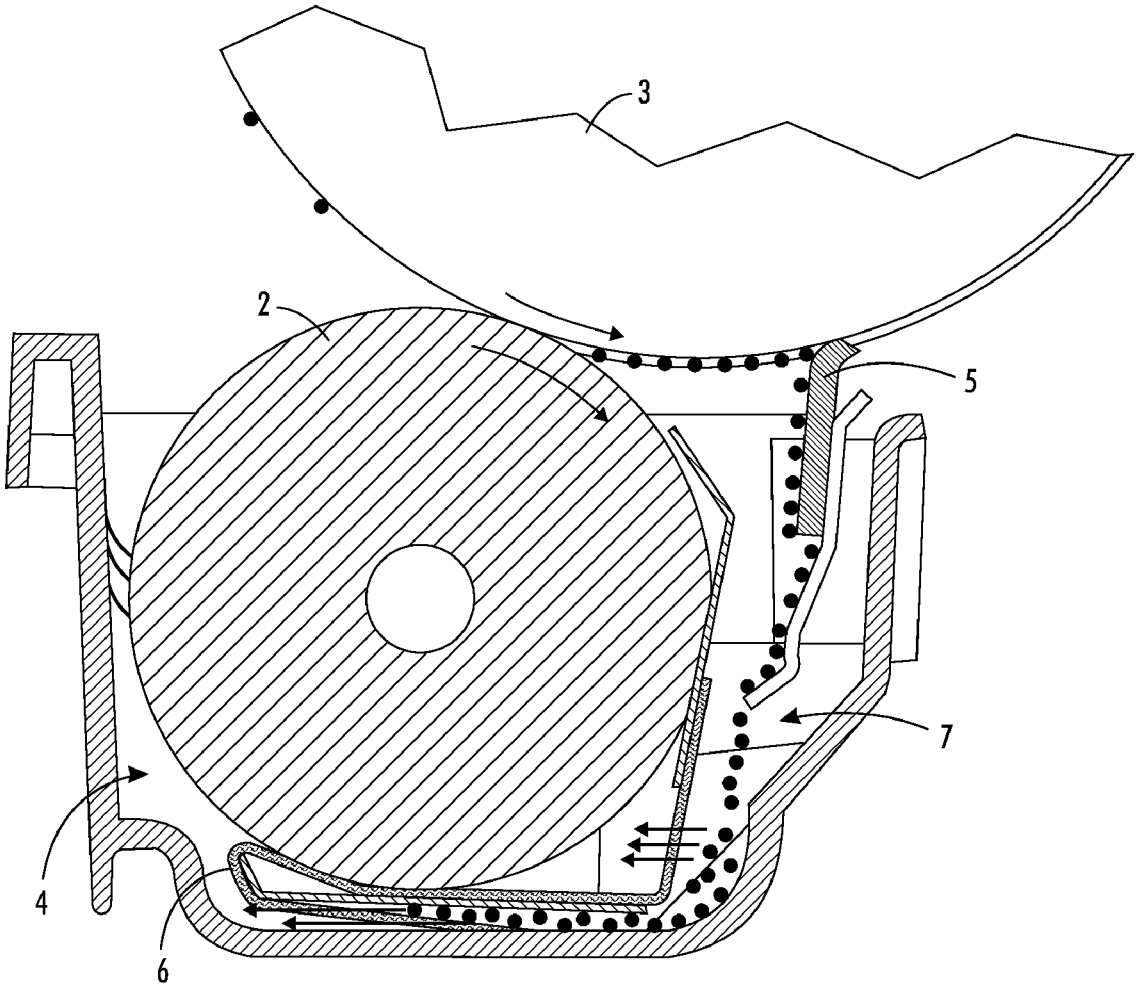
FIG. 5 PRIOR ART
FIG. 5 shows a prior art embodiment of a drum maintenance system.

The shield 120 is spaced a suitable distance D apart from the roller 108 so as not to interfere with the rotation of the roller 108. In one embodiment, the shield 120 the distance D is approximately 2 mm although any suitable spacing may be used. The shield 120 is also spaced from the side wall 124 of the housing 104 and attached to the housing 104 to define a cavity 130 which forms a portion of the reclaimed release agent flow path. The metering blade 114 is positioned to divert excess release agent into the cavity and thus into the reclaimed release agent flow path for the DMU. The cavity 130 in turn guides the diverted release agent to the main sump area 110 under the roller 108. As depicted in FIG. 3, the positioning of the metering blade and shield enable the reclaimed release agent to drip or fall directly into the cavity 130 without having to be guided along various surfaces in the DMU as is the case in some previously known systems such as depicted in FIG. 5. The configuration of FIG. 2 shortens the time it takes for the release agent to travel to the sump to be absorbed and reduces the likelihood of a spill if the DMU is removed from the printer and tilted or dropped.

The shield 120 includes at least one hole or opening therethrough, such as opening(s) 134, located near the bottom surface 128 of the sump 110 which permit the release agent to escape from the cavity 130 into the main sump area 110 under the roller 108. A plurality of pass-through openings 134 may include one or more perforations within the length of the shield 120 and/or by pass openings between the shield and the interior of the DMU housing 104. The openings 134 may have any width, diameter or shape that enables release agent to travel from the cavity 130 to the sump 110. In one embodiment, the openings 134 are sized to filter debris particles of a predetermined size from the reclaimed release agent prior to the release agent reaching the main sump area 110.

A filter 118 is provided in the sump area 110 to filter the release agent that enters the sump 110 from the cavity 130 before the reclaimed release agent reaches the roller. In particular, the filter 118 provides a permeable barrier between the roller and the bottom surface of the sump through which the reclaimed release agent must pass before reaching the roller. In one embodiment, the filter 118 comprises a contact filter that is supported against the surface of the roller. The filter 118 is configured to remain substantially stationary as the roller rotates to apply release agent to the drum. Accordingly, the filter is formed of a suitable low friction filter material that enables a substantial portion or all of the surface area of the filter to be supported in contact with the roller without generating a significant amount of friction between the roller and filter 118 under so as to not impede nominal rotational movement of the roller during drum maintenance operations. In one embodiment, the filter 118 is formed of a synthetic nonwoven textile, such as polyester felt although any suitable material may be used.

As mentioned, filter 118 is supported against the surface of the roller which enables the filter 118 to transfer reclaimed release agent to the roller as it is being filtered. In previously known systems such as depicted in FIG. 5, the filter was supported or held against the roller using a rigid support, such as a bracket. While such a configuration may be effective in maintaining a filter in contact with the roller, such a configuration is susceptible to deviations in the geometry or positions of the roller and/or the rigid filter support which may result in undesirable deviations in the force or contact between the roller, filter, and filter support from nominal or desired force or contact levels. Such deviations may result in the contact force between the roller, filter, and filter support being increased to a degree that prevents or impedes rotation of the roller.

As an alternative to the use of a rigid support structure for supporting the filter against the roller, the filter 118 of FIG. 3 is supported against the roller by a compressible porous layer 138 that is positioned on the bottom surface 128 of the sump beneath the roller 108 and filter 118. The filter 118 is positioned on top of the compressible porous layer 138 and is pressed against the roller surface by the compressible porous layer 138 so that the filter 118 is sandwiched between the roller 108 and the foam layer 138. In addition to providing the normal force for supporting the filter against the roller, the porous layer comprises a portion of the reclaim path for the reclaimed release agent that enables the release agent to be transferred to the roller from the bottom surface of the sump. As used herein, the term porous with reference to layer 138 refers to the ability of the layer 138 to allow fluid, such as release agent, to pass therethrough.

In one embodiment, the foam layer comprises an open-cell urethane foam having a pore size that enables the foam layer to absorb the reclaimed release agent in the sump and wick it or transfer it toward the filter 118. Any suitable porous or absorbent material, however, may be used. In embodiments, the porous layer may be configured to provide a filtering function to augment the filtering function of the filter layer 118 or to provide all or a substantial portion of the filtering function in lieu of the filter layer 118. For example, the pore size for the porous layer 138 may be selected to trap debris particles of a predetermined size. Subsequent descriptions most often will include reference to filter 118 but it is to be understood that adequate filtration may be provided by porous layer 138.

In one embodiment, the compressible porous layer 138 is adhered to the bottom surface 128 of the sump 110 beneath the roller by a suitable adhesive material or by other suitable means to maintain the layer 138 in position as the roller rotates against the filter. Frictional contact between the porous layer 138 and the filter 118 may be used to maintain the filter in position against the rotation of the roller. In some embodiments, however, the filter 118 may be adhered to the porous layer or formed as a component of the porous layer.

Figure 4:
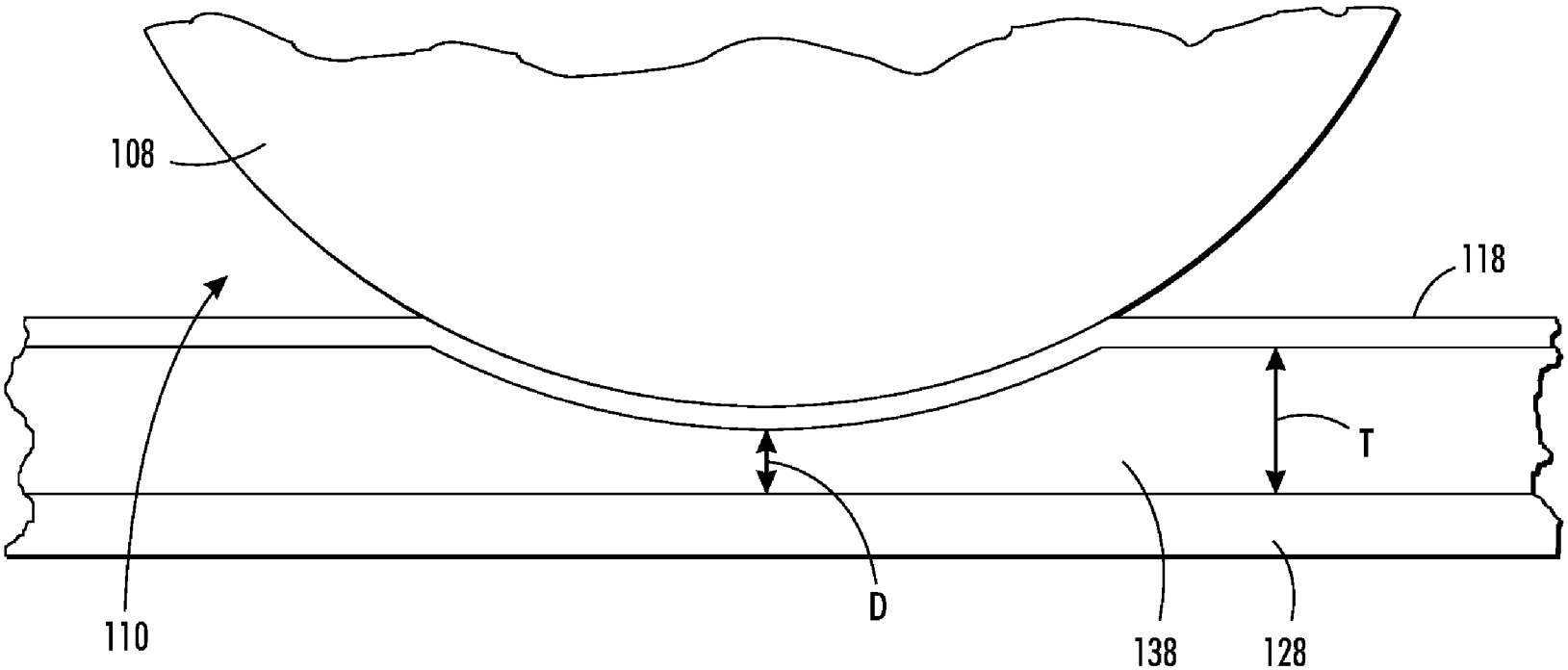
FIG. 4 is a more detailed view of the compressed foam layer, filter and applicator of the drum maintenance unit of FIG. 3.

As best seen in FIG. 4, the porous layer 138 has a thickness T in its uncompressed state from the bottom surface 28 of the sump that enables the porous layer to support the filter against the surface of the roller. For example, in one embodiment, the porous layer has a thickness T that is greater than the distance D between the between the roller 138 and the bottom surface 128 when filter 118 is interposed between. The layer 138 is formed of a material having a low force deflection property that enables the layer 138 to be compressed against the bottom surface 128 by the roller 108 and that enables the layer 138, when so compressed, to exert a reactive force over a relatively large surface area that serves to press the filter material against the roller 138. The force between the compressed foam layer and the roller is enough to create and maintain the filter in contact with the roller as the roller rotates without preventing the roller from rotating against the drum surface. Any suitable thickness for the foam layer 138 may be utilized depending on the dimensions of the roller and filter, viscosity of the release agent, rate of rotation of the roller, and the like. In one particular implementation, the compressible porous layer has a thickness T of about ⅛ inches.

One benefit of a porous foam material in addition to providing a fluid pass-through migration path and potentially offering a filtration function, is that a low compressive force is easily obtained. Additionally, the force range over the system level component relationship tolerances can be held to acceptable limits due to the extent of the compression at a limited percentage of the material thickness. Force is not so much the objective as establishing surface contact with the roller but higher forces can impede or prevent roller rotation. Due to the shape of the compressed region in this application and the characteristics of a foam material being used as a spring, such as force reduction with time, typical spring performance specifications are not applicable. Instead, the force and resulting friction must be low enough not to prevent rotation of the applicator during the DM operation. Taking a set over time is also not problematic since contact area, rather than contact force, is the primary function requirement.

During operation, the reclaimed release agent and debris drips off of the metering blade 114 and into the reclaim flow path formed by the cavity 130. The holes 134 in the shield 120 allow the release agent to travel into the bottom of the sump 110 where it is absorbed by the porous layer 138 and transferred to the filter 118. Porous layer 138 presses the filter 118 against the roller 108 which enables the release agent to be transferred to the filter and roller by capillary forces and contact pressure. Filter 118 (and in some embodiments, porous lay 138) filters debris from the release agent as it is being transferred to the roller 108. The configuration of the shield and the use of the porous layer for supporting the filter 118 against the roller 108 enables multiple levels of filtering of the release agent to be provided before the reclaimed release agent reaches the roller 108. For example, the holes in the shield that enable release agent to travel to the sump 110 from the cavity 130 provide a first level, or coarse level, of filtering that removes large particles and contaminants from the reclaimed release agent before reaching the sump 110. The filtered particles remain in the cavity 130 and do not collect in the sump 110 which may interfere with the ability of the porous layer and filter to transfer release agent to the roller. The filter 118 removes debris particles from the release agent prior to the release agent being transferred to the roller 108. The foam layer may also provide an intermediate filtering level for filtering debris particles from the release agent prior to reaching the filter.

One difficulty that may be faced in the operation of a DMU, such as the DMU 100, is the buildup of static electric charge in the area between the roller 108, imaging drum 52, and metering blade 114. For example, after an imaging drum 12 transfers an ink image to a recording substrate some non-transferred ink may remain on the drum. When the roller 108 applies release agent to the drum surface 62, an electrostatic charge may be formed immediately after the roller/drum nip 102. As the drum 52 and the roller 108 separate from one another, the release agent takes a certain polarity of charge and the release agent remaining on the roller 108 retains an opposite charge. Without releasing the electrostatic charge, the charge builds up with the potential of causing an electrostatic discharge or arc to occur. The arc may potentially affect neighboring electrostatically sensitive systems and may cause a system malfunction and/or premature failure of parts within the printer. Charge induced jumping or splashing of release agent and any debris contained in the fluid being reclaimed may occur, causing image quality problems and oil containment issues. Also, as the printing speed of the printer continues to increase, the electrostatic charges amplitude will also increase. Hence, more severe damage and problematic printer performance due to the increase in charge.

In previously known systems, such as depicted in FIG. 5, electric charge was prevented from building up in or around the roller by grounding the rigid filter support and positioning the filter support in contact with the roller to promote charge drain off from the roller. Such contact, however, added to the amount of rotation resisting friction and presented one additional tolerance variable causing that friction range to extend into problematic performance-up to and including prevention of applicator roller rotation.

As an alternative to the use of grounding contact between the roller and a conductive shield as taught by the prior art to prevent electrostatic charge buildup around the DMU and drum, the DMU according to the present disclosure is configured to utilize a non-contact grounding approach for preventing electrostatic charge buildup. As mentioned above, the shield is provided with a conductive grounding element that enables the shield to be connected to ground potential. For example, in one embodiment, the shield 120, or at least the conductive portion or component of the shield, includes a ground terminal 121 or other suitable structure that extends through the DMU housing 104 where it may be connected to ground potential in a suitable manner. To further prevent or limit static charge buildup in or around the DMU, the metering blade may be electrically grounded. For example, as depicted in FIG. 3, the metering blade, or the conductive support bracket 116 for the metering blade, may be operably connected to ground potential The shield, or at least the grounding element of the shield, is spaced apart from, and therefore is not in contact with the roller. However, tests have shown that when the grounding element of the shield is connected to ground, charge buildup in the roller and other components of the DMU is effectively prevented or is at least less than the charge buildup when the grounding element is not connected to ground potential. This performance proves the effectiveness of a non contact ground shield.

Because the DMU 100 is a CRU, the DMU 100 may be easily inserted into and removed from an imaging device for servicing or maintenance procedures. Maintenance procedures may result in the replacement of the DMU with a different DMU, also referred to as a replacement DMU. As used herein, a "different" or "replacement" DMU may comprise new (i.e., previously unused) DMUs or may be DMUs that have been previously used in the same or another imaging device. For example, a "different" or "replacement" DMU may refer to a DMU removed from an imaging device in which one or more of the components of the DMU have been serviced, replaced, cleaned, or repaired prior to reinstalling the DMU in the imaging device.

Maintenance procedures may include the addition or replacement of the release agent in the DMU. Release agent may be replenished in a DMU by adding release agent to sump 110. Maintenance procedures may also include actions that are intended to extend the life of a DMU. For example, maintenance procedures for a DMU may include the cleaning and/or replacement of any or all of the components of the DMU described above including the DMU housing, applicator, metering blade, foam layer, filter, shield wall, and the like. Replacement components for use with a DMU may be unused or previously used components. For example, replacement components for a DMU may be newly manufactured or may be taken from another DMU. As used herein, replacement components for a DMU may also comprise components, parts, pieces, and the like from a DMU that are removed from and reinstalled in the same DMU. To enable servicing or maintenance of the DMU, a portion of the housing may be removed to perform maintenance procedures, such as cleaning, repair, or replacement of one or more components of the DMU. Of course, some maintenance procedures may not require access to interior of the housing or removal of a portion of the housing to be performed, such as the servicing, removing, and/or replacing of externally accessible components of the DMU, such as the applicator roller 108.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A drum maintenance system for use in an imaging device wherein marking material is transferred from an imaging drum to a print sheet, the system comprising:

a sump including a bottom surface and a plurality of sidewalls which are arranged to accommodate a volume of release agent for application to the imaging drum;

an applicator rotatably supported above the bottom surface of the sump;

a non metallic porous compressible layer connected to the bottom surface of the sump and compressed between the applicator and the bottom surface of the sump such that the vertical compressive force does not impede nominal rotation movement of the applicator during a drum maintenance operation;

an adhesive connecting the non metallic porous compressible layer to the bottom surface of the sump; and a filter layer connected to the porous layer with another adhesive layer and the filter layer being sandwiched between the applicator and the porous layer.

2. The system of claim 1, the filter layer being formed of a polyester felt material.

3. The system of claim 1, further comprising:

a housing enclosing the sump and the roller applicator, the housing being configured for insertion into and removal from the imaging device.

4. A drum maintenance system for use in an imaging device wherein marking material is transferred from an imaging drum to a print sheet, the system comprising:

a sump including a bottom surface and a plurality of sidewalls which are arranged to accommodate a volume of release agent for application to the imaging drum;

an applicator rotatably supported above the bottom surface of the sump;

a non metallic porous compressible layer connected to the bottom surface of the sump and compressed between the applicator and the bottom surface of the sump such that the vertical compressive force does not impede nominal rotation movement of the applicator during a drum maintenance operation;

a shield extending from the bottom surface toward a top of the sump between and spaced apart from the applicator, the non metallic porous compressible layer, and a sidewall of the sump, the shield being spaced from the sidewall a distance to define a cavity between the sidewall and the shield, the shield including at least one opening that fluidly connects the cavity to the sump.

5. The system of claim 4, further comprising:

a metering blade positioned above the cavity.

6. The system of claim 5, the metering blade being attached to an electrically conductive mounting bracket, the mounting bracket being coupled to ground potential.

7. The system of claim 4, the porous compressible layer being formed of an open-cell urethane foam.

8. The system of claim 4, the shield including an electrically conductive grounding element configured for connection to ground potential.

9. A drum maintenance system for use in an imaging device wherein marking material is transferred from an imaging drum to a print sheet, the system comprising:

a sump including a bottom surface and a plurality of sidewalls which are arranged to accommodate a volume of release agent for application to the imaging drum;

an applicator rotatably supported above the bottom surface of the sump;

a non metallic porous compressible layer connected to the bottom surface of the sump and compressed between the applicator and the bottom surface of the sump such that the vertical compressive force does not impede nominal rotation movement of the applicator during a drum maintenance operation; and a shield spaced apart from the applicator and the non metallic porous compressible layer, the shield being positioned between the applicator and one of the side walls of the housing, the shield being spaced from at least one of the sidewalls to define a portion of a reclaimed release agent flow path therebetween, the reclaimed release agent flow path being configured to receive release agent diverted from the imaging drum, and the shield includes an electrically conductive grounding element for connection to ground potential.

10. The system of claim 9, further comprising:

an adhesive layer connecting the non metallic porous compressible layer to the bottom surface of the sump; and a filter layer connected to the non metallic porous compressible layer with another adhesive layer and the filter layer being sandwiched between the applicator and the porous layer.

11. The system of claim 10, the filter being formed of a polyester felt material.

12. The system of claim 11, further comprising:

a metering blade supported above the sump for metering the release agent applied to the surface of the imaging drum and diverting excess release and debris from the surface of the imaging drum toward the reclaimed release agent flow path.

13. The system of claim 12, the metering blade being operably coupled to ground potential.

14. The system of claim 9, the porous compressible layer being formed of a polyurethane foam material.

15. The system of claim 14, the polyurethane foam material being formed of an open-cell urethane foam.

* * * * *